United States Patent [19]

Hebert et al.

[11] Patent Number: 4,575,216

[45] Date of Patent: Mar. 11, 1986

[54] ELECTROPHOTOGRAPHIC COPYING APPARATUS INCLUDING TRANSFER CHARGE CORONA AND SHIELD

[75] Inventors: Richard D. Hebert, Sunnyvale; Victor B. Van Blerk, San Jose, both of Calif.

[73] Assignee: Ricoh Company, Ltd., Tokyo, Japan

[21] Appl. No.: 549,873

[22] Filed: Nov. 9, 1983

[51] Int. Cl.[4] ..... G03G 15/16

[52] U.S. Cl. ..... 355/3 TR; 355/3 CH; 355/14 TR

[58] Field of Search ..... 355/3 R, 3 TR, 14 TR, 355/3 CH, 14 CH

[56] References Cited

U.S. PATENT DOCUMENTS 3,620,617 11/1971 Kelly et al. ..... 355/3 TR
3,850,519 11/1974 Weikel ..... 355/3 TR
3,966,199 6/1976 Silverberg ..... 355/3 TR X
4,260,235 4/1981 Stack ..... 355/3 CH
4,416,531 11/1983 Mayer ..... 355/3 TR

*Primary Examiner*—Fred S. Braun
*Attorney, Agent, or Firm*—Flehr, Hohbach, Test, Albritton & Herbert

[57] ABSTRACT

In an electrophotographic copier, a dielectric shield is provided extending from a point adjacent the corona discharge device to a point close to the entry of the charged surface sheet of paper into the transfer nip area. The ion shield is formed of a sheet of dielectric material which extends from the cover of the corona discharge device to a point only slightly displaced to the entry side of the transfer nip. The ionic shield is biased to press against the surface of the paper so that air flow leakage to the surface of the photoconductive drum is minimized. The air flow which is naturally created by the movement of the paper is channelled out to the sides of the dielectric shield and is disbursed in an area away from the photoconductive drum.

10 Claims, 1 Drawing Figure

Figure 1:
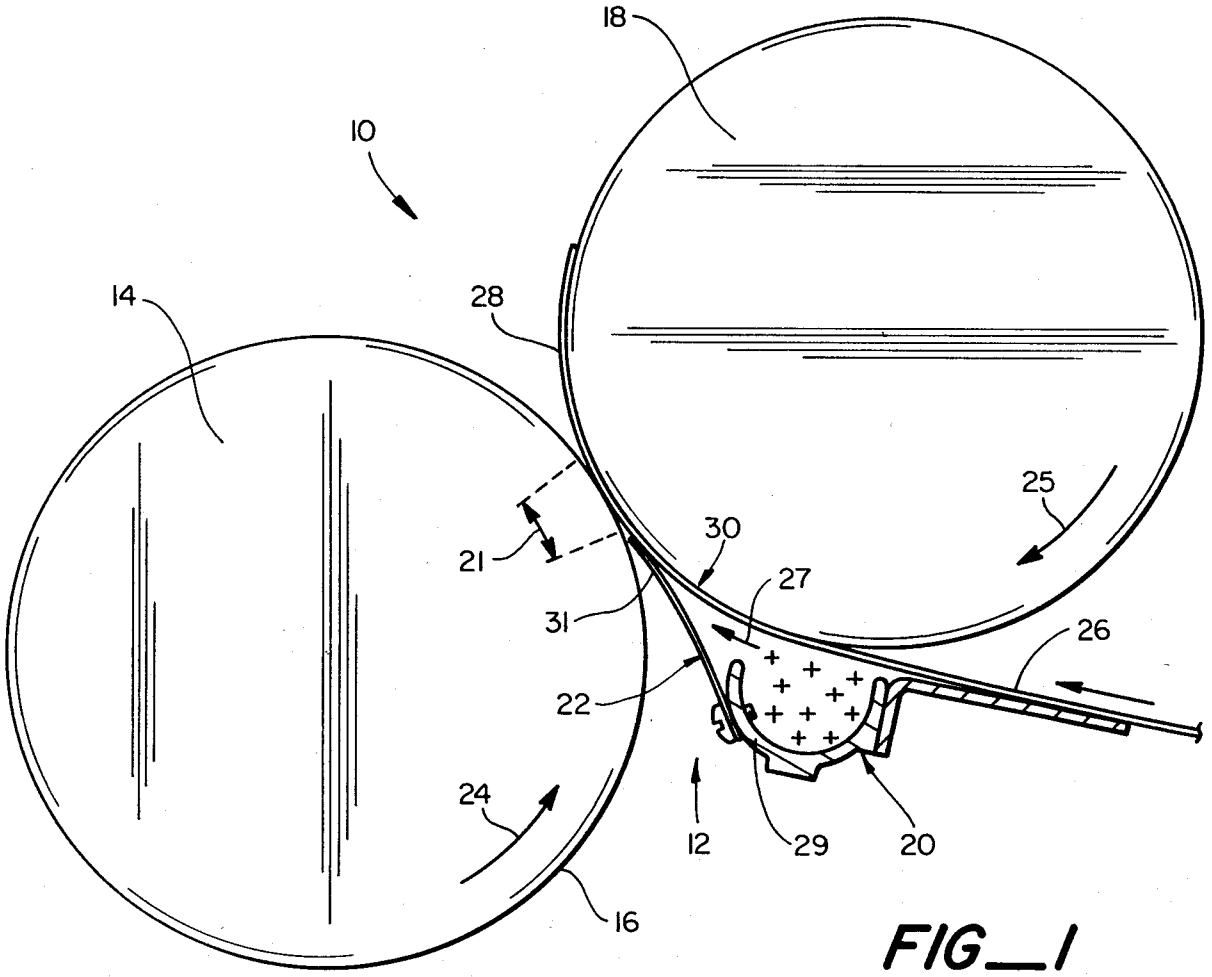

ELECTROPHOTOGRAPHIC COPYING APPARATUS INCLUDING TRANSFER CHARGE CORONA AND SHIELD

The present invention relates generally to electrophotographic copying apparatus in which electrically charged toner of one polarity is transferred from an oppositely charged electrostatic image on the outer surface of the photoconductive drum to the front side of a blank sheet for transforming the latter into an intended copy as the back side of the sheet engages the outer surface of the transfer roll positioned adjacent to the drum. This apparatus relates particularly to a transfer charge corona for placing a uniformly distributed ionic charge on the blank paper, and a shield for preventing charge leakage from the ionically-charged paper and the charge corona to the surface of the photoconductive drum.

The present invention is especially suitable for use in a typical electrophotographic apparatus which is presently being used in the industry. This typical apparatus includes a rotatable drum having a photosensitive outer circumferential surface, and means for rotating the drum in a controlled fashion so that its outer circumferential surface defines a fixed annular path of movement. The apparatus produces copies from a given master by first forming an electrostatic image corresponding to the particular information to be copied on the photosensitive outer circumferential surface of the drum. Thereafter, the latent image is developed by means of the toner particles, specifically electrically charged heat fusible particles, which are applied to the image bearing surface in a specific way. Finally, the applied toner particles are transferred from the drum to the blank sheet and thereafter fused thereon for transforming the sheet into a permanent copy.

In the apparatus just described, the toner transfer step is carried out with the aid of a transfer roll in cooperation with the blank sheet and photoconductive drum. More specifically, the transfer roll is designed to receive the back side of the blank sheet; rotation of the transfer roll places the front side of the sheet in engaging confronting relationship with the toner carrying outer surface of the photoconductive drum in an area termed the transfer nip. This causes the toner on the drum to engage the blank paper. The toner particles are electrically charged (typically negative) and the electrostatic image on the photoconductive drum is biased with the voltage of the opposite polarity (typically positive) to form the latent image. In order to cause the toner particles to move more easily from the drum to the paper, an electric field is created in the transfer nip, by charging the paper and biasing the transfer roll to the same polarity as that of the drum but at a higher voltage level.

It is known to accomplish the charging of the paper by an electrically charged brush as in U.S. Pat. No. 4,341,456 or by depositing positive ionic charges directly on the front face of the paper as in U.S. application Ser. No. 199,096 filed Oct. 20, 1980, now U.S. Pat. No. 4,384,784, and assigned to the assignee of the present invention. It has been discovered, however, that a problem with applying charge to the paper prior to its reaching the transfer nip is created by the fact that the rotation of the transfer roll which is closely adjacent to the paper path results in a flow of air along the paper and into the transfer nip area. It is known that a charged corona is essentially an electrical arc type of discharge, creating what is essentially a cloud of ionic charges through which the surface of the paper to be charged passes. Thus there are positive ions which do not wind up on the paper, but rather are picked up by the air flow stream created by the moving paper. If carried into the transfer nip, these ions can seriously degrade the image on the photoconductive drum; since the ions are of the same polarity as the charged distribution on the surface of the photoconductive drum which is used to define the image, to the extent that the ions reach the surface of the drum these ions could effectively change portions of the image on the photoconductive drum from white to gray and gray to black.

It is therefore an object of this invention to provide an ion shield adjacent the paper path as it passes the transfer corona and moves toward the transfer nip to prevent the ion carrying air flow from reaching the surface of the photoconductive drum.

It is a further object of the present invention to provide means for channeling the charged ion particle air stream away from the surface of the photoconductive drum, to prevent degradation of the image prior to the entry of the blank sheet of paper into the transfer nip.

These and other objects are accomplished in accordance with the present invention by providing a dielectric shield from a point adjacent the corona discharge device to a point close to the entry of the charged surface sheet of paper into the transfer nip area. In a preferred embodiment of the invention, the ion shield comprises a sheet of dielectric material which extends from the cover of the corona discharge device to a point only slightly displaced to the entry side of the transfer nip; preferably, the ionic shield is biased to press against the surface of the paper so that air flow leakage to the surface of the photoconductive drum is minimized. According to this preferred embodiment, the air flow which is naturally created by the movement of the paper is channelled out to the sides of the dielectric shield and is disbursed in an area away from the photoconductive drum.

The overall apparatus including the various features just recited will be described in more detail hereinafter in conjunction with the drawing wherein FIG. 1 illustrates a cross-sectional view of a specific toner transfer station designed in accordance with the present invention.

FIG. 1 illustrates part of an electrophotographic copying apparatus and specifically a toner transfer station generally indicated at 10 forming part of this apparatus. The apparatus includes a rotatable photoconductive drum 14 which is rotated by means not shown in a controlled manner to move its outer photoconductive surface 16 along a fixed annular path through a charging station, an exposure station, a developing station and thereafter a transfer station 12. None of these stations are illustrated except for transfer station 12 which is shown including a rotatable transfer roll 18 and a charge corona device 10 having an associated ionic shield 22.

In operation of the copying apparatus, photoconductive drum 14 rotates in the direction of arrow 24 to carry a segment of the drum's outer surface 16 through the charging station in order to cause a segment of the surface to charge to the desired voltage level and polarity, for example +500 volts. Thereafter, the charged surface segment is moved through the exposure station where a like image of an original or master is projected onto the moving drum 14 in order to discharge portions of its charged surface and thereby form an electrostatic image conforming to the original as represented by various voltage levels up to a maximum of the original +500 volts provided. The various shades of white through black are represented by the voltage levels of some minimum positive voltage up through +500 volts. The electrostatic image thus formed is then moved through the developing station which contains a suitable arrangement including a supply of heat fusible toner charged to a polarity opposite that of the latent image. In this example the toner has a negative polarity; as the image bearing drum's surface moves through the developing station, the charged toner is applied thereto, causing it to develop the image. Immediately after the latent imaged on the drum has been developed, it is moved to transfer station 12 which includes the previously mentioned transfer roll 18 and a corona discharge device for precharging the paper generally indicated at 20. Image transfer from photoconductive drum 14 to paper 26 will then occur within transfer nip 21.

The transfer station 12 also includes means (not shown) supporting the transfer roll for free rotation or rotating it in a positive manner in the direction of arrow 25 and means (again, not shown) for carrying a supply of blank paper 26 through a fixed path past the corona charging station 20, against the transfer roll 18 and into the transfer nip 21 where it engages the outer surface of the photoconductive drum 16 such that the toner on the drum is transferred to the blank sheet in the manner to be described below, thereby forming a copy of the original as indicated by transfer toner generally represented by reference 28. Immediately after the toner is transferred to paper 26, the latter is caused to move through the fusing station which, as stated above, fuses the toner onto the paper thereby providing a permanent copy.

The specific improvement provided by this invention lies in maximizing the efficiency of transfer of the image represented by the toner adhering to the surface 16 of the photoconductive drum to the blank paper 26 as it moves through the transfer nip 21, while minimizing the degradation of the image on the surface 16 of the photoconductive drum as represented by the varying pattern of electrostatic charges on the drum surface. For purposes of description, it will be assumed that the electrostatic latent image on surface 16 is positively charged to a maximum of +500 volts, and that the toner particles are negatively charged (although the polarities could be reversed). By appropriate biasing of the transfer roll 18, and with the supplementary ionic charging of the front surface of the paper 26, the positive voltage gradient at the transfer nip 21 is in the direction of the transfer roll 18 from the photoconductive drum 14, provided that the positive voltage at the roll 18 is of a level substantially greater than the maximum voltage level forming the electrostatic image. In this way, there is a sufficient positive voltage level differential between the paper 26 and the photoconductive drum 14 to cause the toner particles to be drawn off the latent image on the drum and onto the paper in a replication of the image defined by the positive charge pattern on the drum 14.

It is apparent that the voltage gradient in favor of the transfer roll and thereby the blank sheet 26 carried on the front surface of the transfer roll is maximized by providing an even ion charge distribution across the surface of the blank sheet 26. This is provided in accordance with the application incorporated above by a corona discharge device positioned adjacent the front surface of the paper 26. However, it has been found that this corona discharge device must be placed relatively closely both to the point where the blank sheet 26 comes in contact with the transfer roll 18, and closely adjacent the transfer nip region 21. It has also been found that the rotation of the transfer roll 18 results in a flow of air along the paper 26 and into the nip area 21. In charging the paper by means of corona discharge, there are inherently positive ions which do not wind up on the front surface of the paper, but rather are drawn into this flowing air stream indicated generally at 27. It is apparent that this would result in a problem in the maintenance of the image represented on the front surface 16 of the drum 14 if these ions reach the photoconductive drum. The change of charge distribution could alter the white tones to gray and the gray to black by causing migration of toner particles, or by reducing the voltage gradient in favor of the transfer roll 18 from the photoconductive drum 14. This would especially be a problem if an effort were being made to make multiple copies without re-exposure of the photoconductive drum to the master.

Therefore, in accordance with the present invention an ion shield 22 is provided which is attached to the side of the corona discharge shield 29 which is closest to the transfer nip, and extends in the direction of the transfer nip. Preferably, the ion shield 22 comprises a sheet of dielectric material such as Mylar so that no penetration of the floating ions carried by the air shield is possible through the sheet. Rather, to the extent that the change in air flow caused by the shield does not simply create turbulence in the area of the corona discharge device, the air flow near the transfer nip would be either into or out of the paper at the point 30. A further potential advantage of this invention resides in the fact that trapping the air stream close to the surface of the paper further promotes distribution of the ionic charge across the surface of the paper, thereby maximizing to the extent possible the charge distribution on the front surface of paper 26 and therefore the positive voltage gradient in favor of all surface areas of the paper.

It should also be noted that the Mylar sheet is capable of being distorted somewhat by the application of pressure. Therefore, by choosing a point on the curved surface of the corona discharge shield 29 such that the dielectric shield 22 does not extend directly towards the nip 21 but rather is biased inwardly toward the transfer roll 18, the ionic shield 22 is biased against the front surface of the paper 26, thereby forming a pressure seal between the distal end 31 of the ionic shield 22 and the front surface of the paper 26 to prevent air leakage into the transfer nip and thereby avoid leakage of ions into this transfer nip.

Modifications or improvements to the ion shielding device described above may become apparent to one of skill in the art after studying this invention disclosure. Therefore, the scope of the present application is not intended to be limited to the preferred embodiment described above, but only by the appended claims.

What is claimed is:

1. In an electrophotographic copying apparatus in which electrically charged toner of one polarity is transferred from an oppositely electrically charged surface of a photoconductive drum to the front side of a blank sheet for transforming the latter into an intended copy as the back side of the sheet follows a paper path which causes the back surface of said sheet to engage the outer surface of a transfer roll positioned adjacent said drum, said photoconductive drum and transfer roll defining a transfer nip wherein said toner transfer occurs, the improvement comprising means for applying an electrical ion charge to the side of said blank sheet which is to receive said toner, and means for shielding said ionically charged paper from said photoconductive drum prior to its entry into the nip, said shield means extending adjacent said paper path between said means for applying electrical charge to said paper and said transfer nip and being biased against said paper to prevent ions from said charging means from reaching the surface of said photoconductive drum.

2. The improvement according to claim 1 wherein said means for applying an electrical charge is positioned adjacent the path of the paper substantially adjacent the point where the back surface of said paper engages said transfer roll.

3. The improvement according to claim 1 wherein said means for applying an electrical charge comprises a corona discharge device adjacent said paper path for substantially evenly ionizing the front surface of said paper.

4. The improvement according to claim 3 wherein said shield means comprises a dielectric sheet having one end fastened to said corona discharge device and its other end biased to rest against said paper at a point closely adjacent said transfer nip.

5. The improvement according to claim 4 wherein said shield means comprises means for establishing an air circulation path directed away from said transfer nip for carrying excess charged ions from said charging device away from said transfer nip.

6. The improvement according to claim 1 wherein said shield means comprises a dielectric layer lying adjacent said paper path and between said path and said photoconductive drum downstream of said ion charging means to prevent ions from said charging means from contaminating the surface of said photoconductive drum.

7. In an electrophotographic copying apparatus in which electrically charged toner of one polarity is transferred from an oppositely charged electrostatic toner image on the outer surface of a photoconductive drum to the front side of a blank sheet for transforming the latter into an intended copy as the back side of the sheet engages the outer surface of a transfer roll positioned adjacent said drum to define a transfer nip wherein said image transfer takes place, said outer surface of said drum being capable of retaining said electrostatic toner image, the improvement comprising means for providing an electrical ion charge distribution across the surface of said paper, prior to said paper reaching said transfer nip, of the same polarity as said drum surface and at a voltage level which is greater than the voltage level of said electrostatic toner image, whereby to cause toner to be transferred from said drum surface to said blank sheet, and means for shielding said photoconductive drum from said ion charging means, said shield means comprising a dielectric shield positioned adjacent the path of said paper downstream of said ion charging means and extending forward of said transfer nip to prevent said ion charge distribution generated by said charging means from reaching the surface of said photoconductive drum.

8. The improvement according to claim 7 wherein the front side of said blank sheet and the outer surface of said transfer roll are both effectively electrically biased to transfer said image from said photoconductive drum to the front surface of said paper.

9. The improvement according to claim 7 wherein said means for providing an ion distribution comprises a corona discharge device and said dielectric shield has one end fastened to said corona device and its other end is biased to rest against said paper at a point closely adjacent said transfer nip.

10. The improvement according to claim 7 wherein said shield means comprises means positioned adjacent said paper for establishing an air circulation path directed away from said transfer nip for carrying excess charged ions from said charging device away from said transfer nip.

* * * * *